United States Patent [19]

Wankel

[11] Patent Number: 4,561,836

[45] Date of Patent: Dec. 31, 1985

[54] ROTARY PISTON MACHINE

[76] Inventor: Felix Wankel, Bregenzer Strasse 82, D-8990 Lindau/Bodensee, Fed. Rep. of Germany

[21] Appl. No.: 667,072

[22] Filed: Nov. 1, 1984

Related U.S. Application Data

[63] Continuation of Ser. No. 367,861, Apr. 13, 1982, abandoned.

[30] Foreign Application Priority Data

Apr. 14, 1981 [CH] Switzerland ..... 2482/81

[51] Int. Cl.[4] ..... F04C 29/00

[52] U.S. Cl. ..... 418/183; 418/191; 418/189

[58] Field of Search ..... 418/183, 186–191, 418/225, 227

[56] References Cited

U.S. PATENT DOCUMENTS

| | | | |
|---|---|---|---|
| 12,874 | 11/1908 | Bleecker | 418/188 |
| 516,385 | 3/1894 | Weston | 418/143 |
| 893,485 | 7/1908 | Grinrod | 418/191 |
| 1,978,480 | 10/1934 | Svenson | 418/190 |
| 2,724,340 | 11/1955 | Tryhorn | 418/190 |
| 3,439,582 | 4/1969 | Smith | 418/183 |
| 3,600,114 | 8/1971 | Dvorak | 418/55 |
| 3,612,735 | 10/1971 | Graham | 418/189 |
| 3,923,014 | 12/1975 | Knickerbocker | 123/249 |
| 3,990,409 | 11/1976 | Beverly | 123/246 |
| 4,068,988 | 1/1978 | Webb | 418/189 |

FOREIGN PATENT DOCUMENTS

| | | | |
|---|---|---|---|
| 637521 | 3/1962 | Canada | 418/191 |
| 503579 | 8/1940 | Fed. Rep. of Germany . | |

OTHER PUBLICATIONS

Rotary Compressor Development, The Oil Engine, Mar. 1955, p. 418.

*Primary Examiner*—Leonard E. Smith
*Assistant Examiner*—Jane E. Obee
*Attorney, Agent, or Firm*—Toren, McGeady, Stanger, Goldberg & Kiel

[57] ABSTRACT

A rotary piston machine, in order to avoid losses due to compressed flows, has adjacent to a generating and/or sealing contact edge (21, 22) at least one recess (11*a*, 11*e*) and/or opening (12*a*, 12*b*) which extends beyond the contact curve (14*a*–14*c*) in at least approximately the direction of motion of the surfaces moving in relation to each other during the stroke or passage of the piston (6*a*″) through the shut-off driver. The spatial dimensions of the recesses and/or opening are such that the flow in it is not substantially accelerated even when the direction is changed. An opening (11*g*, 11*g*′) can be closed insofar as it is located in a nonmoving ring (6*b*). To prevent low pressures between surfaces moving away from each other (9*c*, 14*c*) a pressure compensation space (11*e*) is connected to the contact line (14*c*) of one of the surfaces.

8 Claims, 32 Drawing Figures

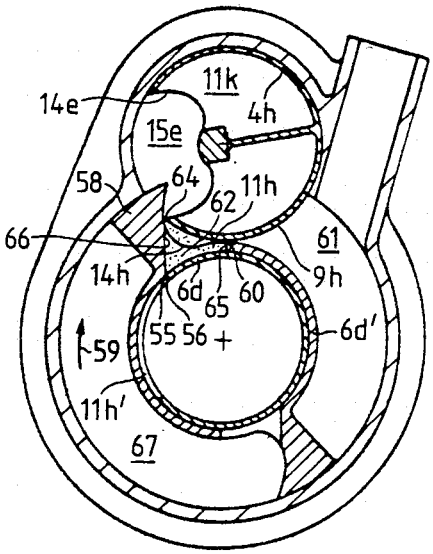
FIG. 20a
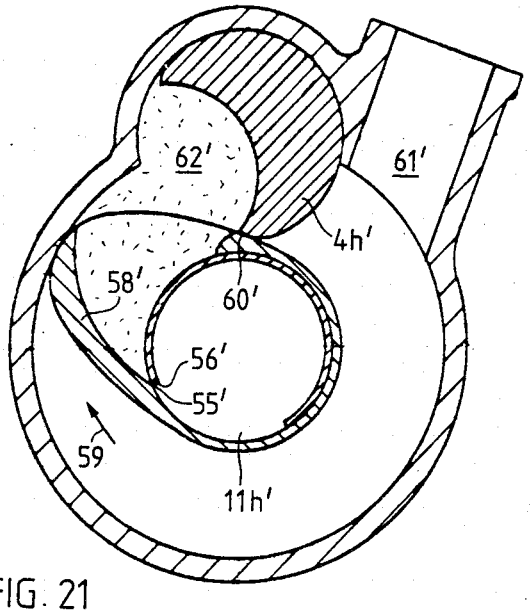
FIG. 21
PRIOR ART
FIG. 20b
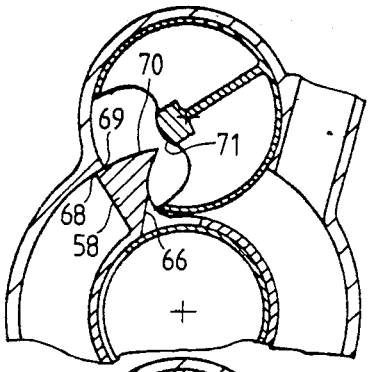
FIG. 20c
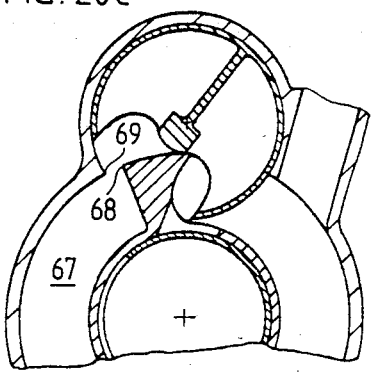
FIG. 20d
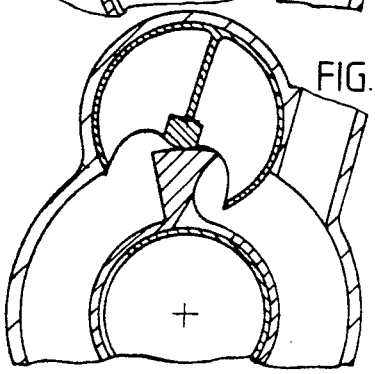
FIG. 20e
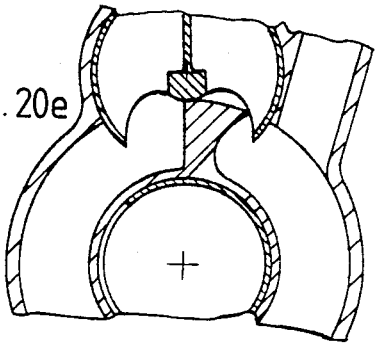

ROTARY PISTON MACHINE

This is a continuation of application Ser. No. 367,861 filed Apr. 13, 1982, now abandoned.

This invention pertains to rotary piston machines and is adapted for utilization in a large number of various embodiments. A general view of the multiplicity of possible designs can be found in the book for professionals by Felix Wankel, "Einteilung der Rotationskolbenmaschinen" (Classification of Rotary Piston Machines) published by Deutsche Verglas-Anstalt, Abteilung Fachverlag, Stuttgart (1963).

Compressed flow of a medium such as a gas that occurs between surfaces moving toward each other often lead to substantial losses of energy. Accordingly, the use of rotary piston machines at high speeds is in many cases not practical, even though such machines are suitable for use at very high speeds because of their counterbalanced drivers or rotors, particularly when they have permanent i.e., fixedly arranged, bearings or supports. An example of such a rotary piston machine would be the widely distributed "Roots" type, in which two rotors with rounded-off convex and concave sections intermesh with each other. By means of this intermeshing motion, the intermeshing surfaces move toward each other so that the operating medium is squeezed out of the gap that is present.

In general a compressed or squeezed flow occurs when a flowing medium being moved from a wall surface not only can move at the speed of such wall surface in its direction, but also is simultaneously forced to move in a more or less transverse direction as the flow profiles or crossections diminish in size, so that it must accelerate considerably. A quickly closed book or handclapping are common examples of compressed flows. An umcompressed flow is present when the flowing material, which is moved by one wall surface against another wall surface, can move at its rate and in its direction ahead of a piston in a cylinder, for example.

In rotary piston machines sealed against high pressures, as for example in a rotary piston engine with its end sealed, the effects of compressed flows and the gas compressions connected with them are less detrimental, since their energy potential is reclaimed. On the other hand, in rotary piston machines that are only sealed by narrow gaps, the high pressures that are produced are lost by flowing off through the seal slits because of compression.

The purpose of this invention is to avoid losses due to compressed flows in a rotary piston machine by providing structural features which enable rotary piston machines to be used with high efficiency in speed ranges in which use of the so-called turbo machines had previously seemed to be necessary. Turbo machines have the disadvantage, however, of poor efficiency when there is a major deviation from the nominal speed, so that, for example, when they are used as turbo superchargers for power machines with internal combustion, they are from a practical standpoint ineffective at lower speeds.

This invention solves the aforementioned problem by avoiding losses due to compressed flows, by the provision adjacent to a generating and/or sealing contact edge of at least one recess and/or opening which extends beyond the meshing curve in at least approximately the direction of the motion of the surfaces moving in relation to each other during the stroke or passage phase. The dimensions of such recess and/or opening are such that the flow in it is not substantially accelerated even when the relative direction of movement between the surfaces is changed.

The relative motion of the surfaces can also be away from each other and thus the recess and/or opening has the function of preventing the reverse of compressed flow by providing adequate flow characteristics such as to prevent any significant drop in pressure. Losses due to low pressure are considerably smaller, however, since the low pressure can only reach 1 bar at most. The size of the recess and/or opening required to prevent losses due to compressed flows in accordance with this invention is arrived at by adapting it to whatever structural characteristics may be present. Small recesses in the size range of surface profilings which cannot prevent any significant acceleration of flow obviously do not fall within the definition of the provided invention. It is also understood that the aforementioned features of the invention are only present where no other space is already present for other reasons. For example, the combustion chamber rotor of a rotary piston machine as set forth in U.S. Pat. No. 3,990,409 has combustion spaces which are similar in form to a recess as set forth in the present invention, since they extend beyond the meshing curve or meshing space of the combustion chamber rotor. In the blocking rotor of this well-known machine, however, the meshing spaces are only approximately the size of the meshing spaces of the piston required for the stroke, so that the piston surfaces move up to the inner wall of the blocking rotor and notable compressed flows occur.

The invention will be explained below with the help of the drawing figures which will clarify the phenomenon of compressed flows and show advantageous embodiments of the invention. There are shown in:

FIGS. 1 and 2 schematic views corresponding to sections from a rotary piston machine to demonstrate the phenomenon of compressed flows, by showing two elements moving toward each other in two positions of their movement;

Figure 22A:
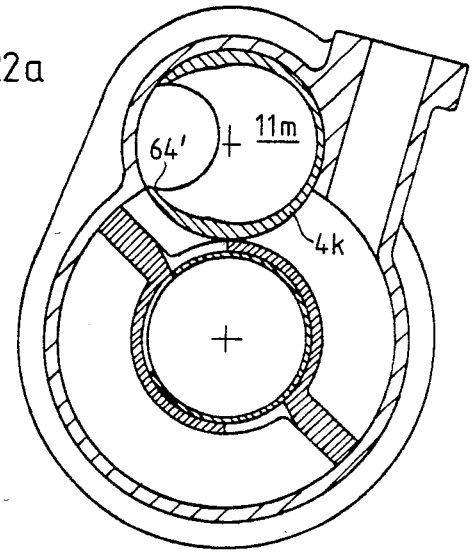
Figure 22B:
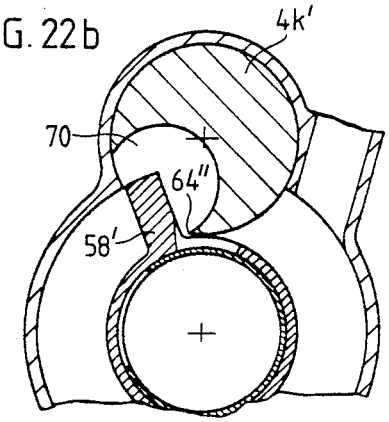
Figure 22C:
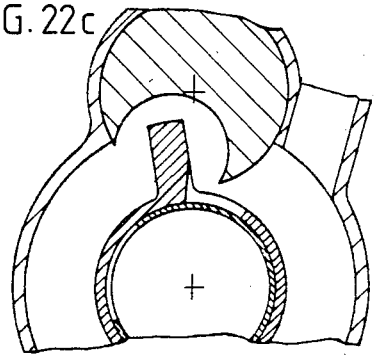
Figure 22D:
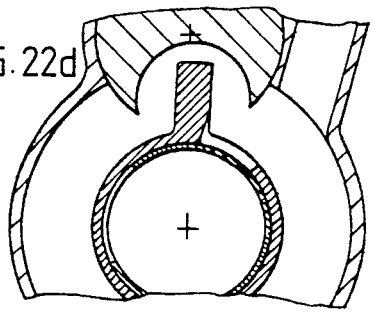
Figure 22E:
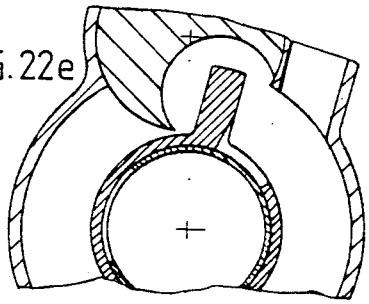
Figure 23:
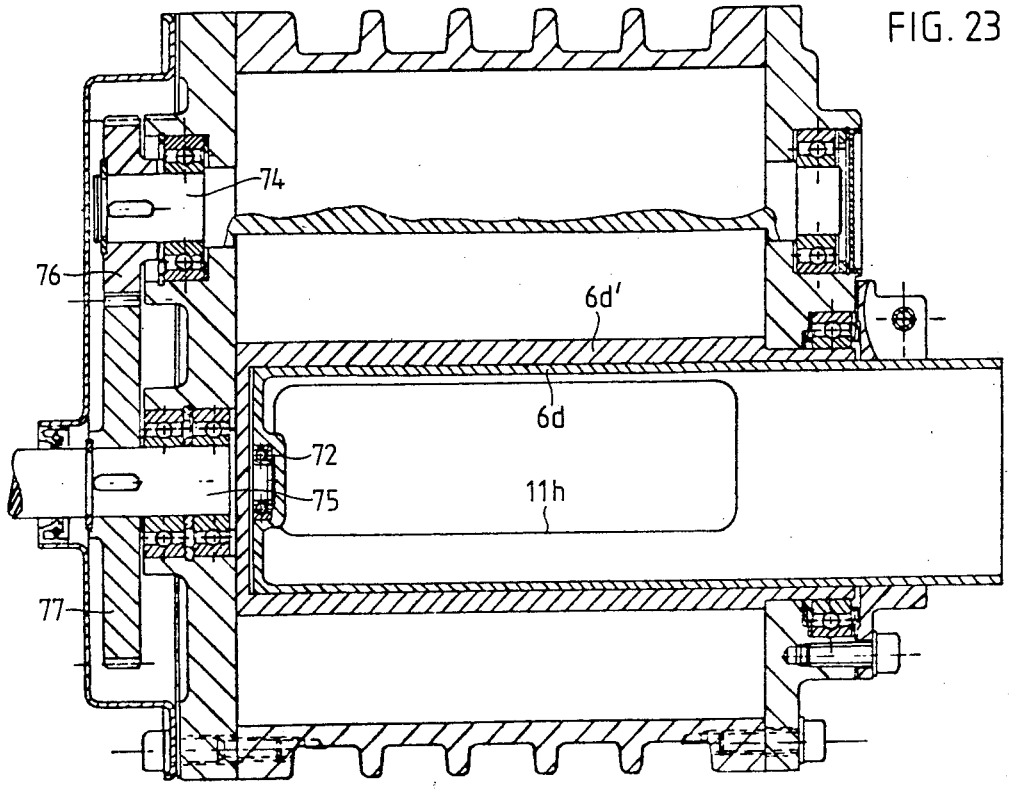
Figure 24:
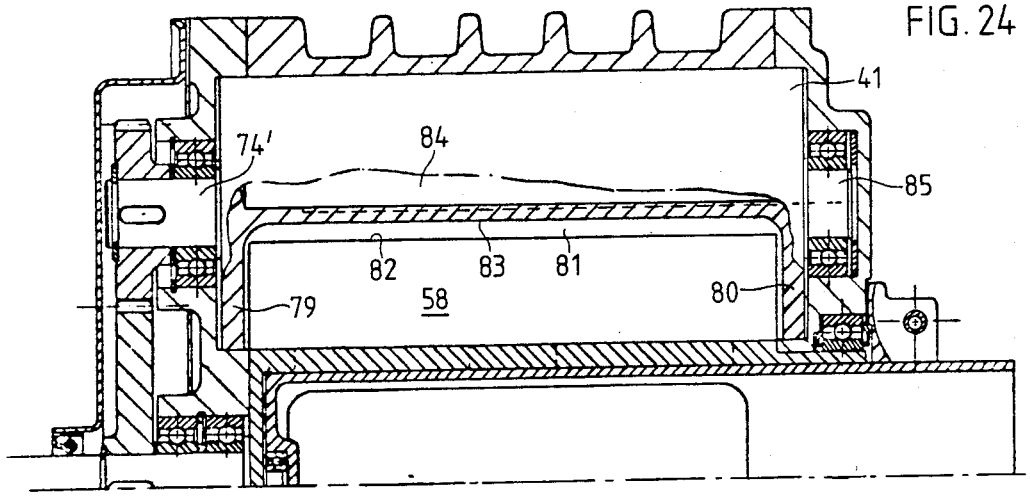

FIGS. 20*a–e* are schematic views of various rotating positions of a further embodiment of a rotary piston machine, in which the main flow is conducted through the hollow shaft of the piston rotor;

FIG. 21 is a schematic sectional view of an essentially well-known rotary piston machine illustrating the size of the detrimental space of well-known machines;

FIGS. 22*a–e* are schematic sectional views of a further embodiment of a rotary piston machine;

FIG. 23 is an axial sectional view of a rotary piston machine as in FIGS. 20 or 22 with an incomplete drawing of the shut-off rotor; and in FIG. 24 is an axial sectional view of an embodiment of a rotary piston machine corresponding to FIGS. 20 or 22 in which the shut-off rotor has lateral sealing walls.

In the schematic views of FIGS. 1 to 6, two elements 4 and 5 or 4 and 6, 6′ are enclosed between two housing plates 2, 3. The elements can move in relation to each other in such a way that, for example, one of the elements 5, 6 stands still while the other slides in a direction toward the element between the housing plates 2, 3. The elements 4, 5 or 6 correspond in these schematic views to a piston rotor 4 and a counter rotor 5, which can also be a rotor or also a peripheral part of the housing.

In order to show the relative motion of elements 4, 5 or 4, 6 toward each other, the gas molecules have been enlarged into balls 7 in the drawing.

Figure 1:
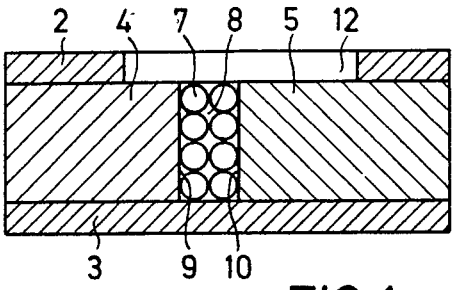
FIG. 1 PRIOR ART
Figure 2:
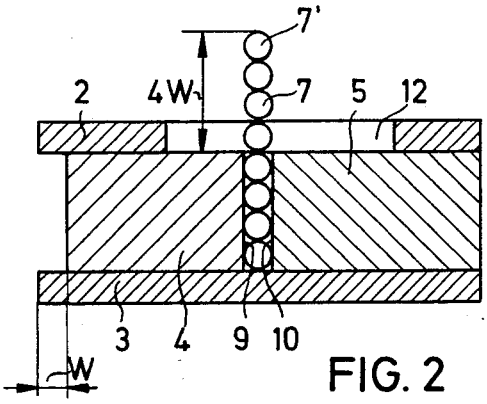
FIG. 2 PRIOR ART

FIGS. 1 and 2 are illustrative of the state of the prior art and they show by means of the two positions of the movement that are depicted that the gas molecules 7 have to accelerate considerably as they move out from the space 8 between the two elements 4 and 5 since such molecules are being squeezed from therebetween. In this embodiment corresponding to the state of the art, the front surfaces 9, 10 of the two elements 4, 5 can move toward each other until they come in contact with each other. The schematic view of FIGS. 1 and 2 shows that the gas molecule 7′ or a corresponding mass of gas has to travel four times the path of movement W of the element 4 in a direction toward the nonmoving element 5, and thus is accelerated considerably when squeezed from between 4 and 5. Any additional movement of the element 4 toward the element 5 produces a corresponding additional acceleration of the gas.

Figure 3:
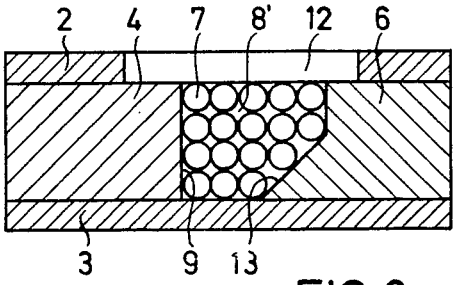
FIGS. 3 and 4 are sectional views corresponding to FIGS. 1 and 2, with one of the elements shaped in accordance with the invention in order to avoid compressed flows.
Figure 4:
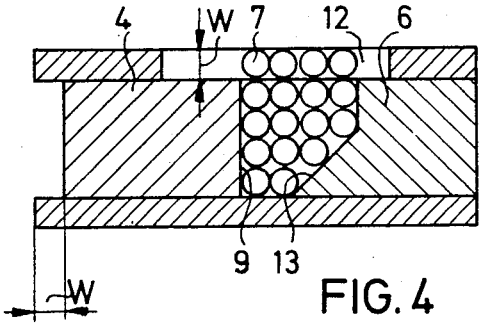

FIGS. 3 and 4 show embodiments of the provided invention in two corresponding positions of their motion with the difference between them being also the distance of the movement path W of element 4. Unlike the state of the art as shown in FIGS. 1 and 2, the gas molecules have to only traverse the same distance W to the side, out of the space 8′ between the two elements 4, 6 so that they are not accelerated and thus no compressed flow is present. According to this invention, in one of the elements 6 a recess 11 (FIG. 5) or 11′ (FIG. 6) is provided allowing the gas molecules 7 to be forced out without acceleration to the side through the opening 12 in the side housing plate 2 without squeezing or compression. The recess 11 extends parallel to the direction of the movement of the elements 4, 6 toward each other beyond the boundary line 14 which indicates the maximum movement mechanically possible for the elements to move towards each other. This boundary line 14 corresponds in rotary piston machines to the meshing line so that the space between the front surface 9 of the element 4 and this meshing line corresponds to the meshing space 15 of the rotary piston machine. i.e., space traversed by an element of the rotary piston machine.

Figure 5:
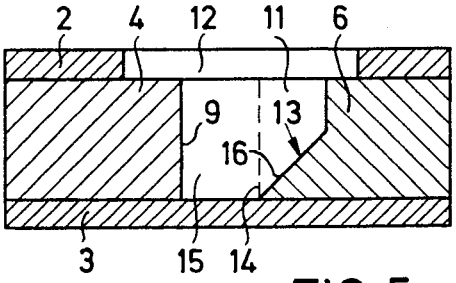
FIG. 5 is a view similar to FIG. 3 without "gas balls;"
Figure 6:
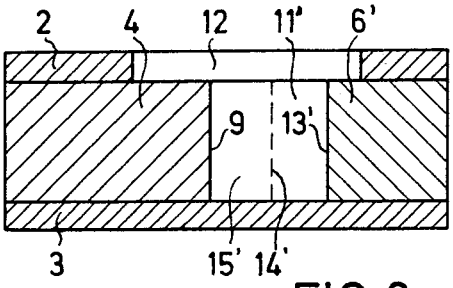
FIG. 6 is a schematic sectional illustration in section of a further machine embodiment made in accordance with this invention.

FIGS. 5 and 6 show in cross-section various shapes of recesses 11, 11′. In the example in FIG. 5 the recess has a deflecting surface 16.

It can be seen in the schematic drawings of FIGS. 3 and 4 that the recess 11, 11′ must be a specific size in order to prevent an acceleration or a considerable local acceleration as the gas is displaced. The recess 11, 11′ preferably is provided in combination with a flow-off or discharge opening 12 which is sufficiently large to prevent an acceleration of the flow by tapering profiles. It is understood that the flow-off opening can also be in the direction of the movement of the elements 4, 6, 6′ toward each other, in which case it must then be possible to close it in accordance with the operating cycle of the rotary piston machine (cf. FIGS. 7–10).

In the following description of exemplary embodiments of this invention depicted in the drawings in FIGS. 7–24, parts that correspond to those in the schematic embodiments of FIGS. 3 to 6 are given the same reference numbers so that the concepts explained by means of FIGS. 3–6 would be especially clear.

The rotary piston machine of the embodiment of FIGS. 7 to 10 is driven by a stream of gas and has appropriately an inlet channel 18 and an exhaust channel 19. One part of the gas flowing off is carried away through the hollow shaft 6*a*′ of the piston rotor with the pistons 6*a*″ through the openings 11*c*, 11*c*′.

Figure 7:
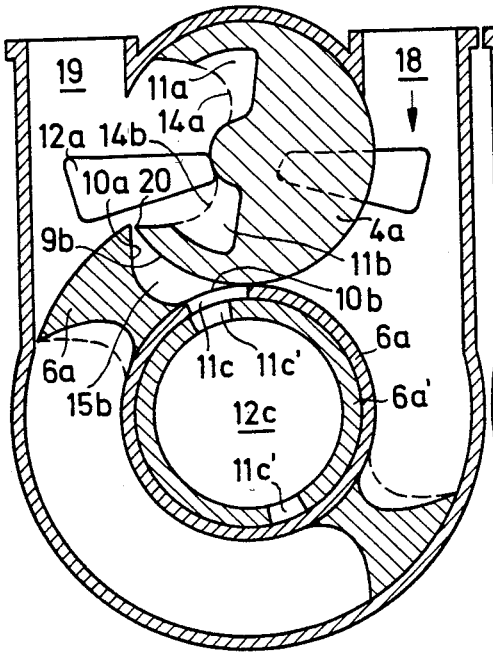
FIGS. 7 to 10 are schematic sectional views of a rotary piston machine in various positions of rotation.
Figure 8:
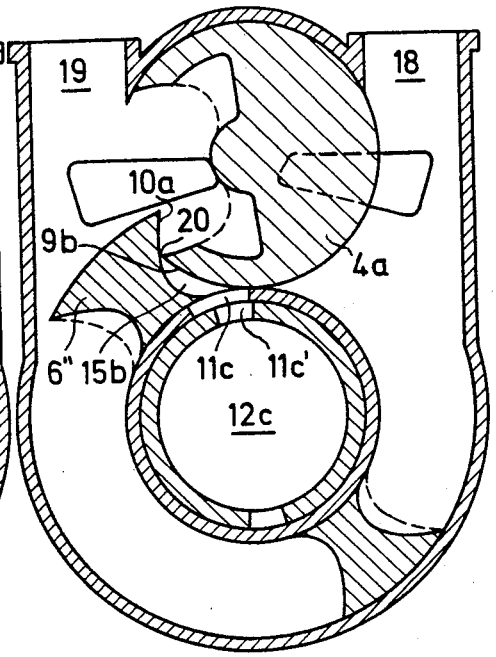
Figure 15:
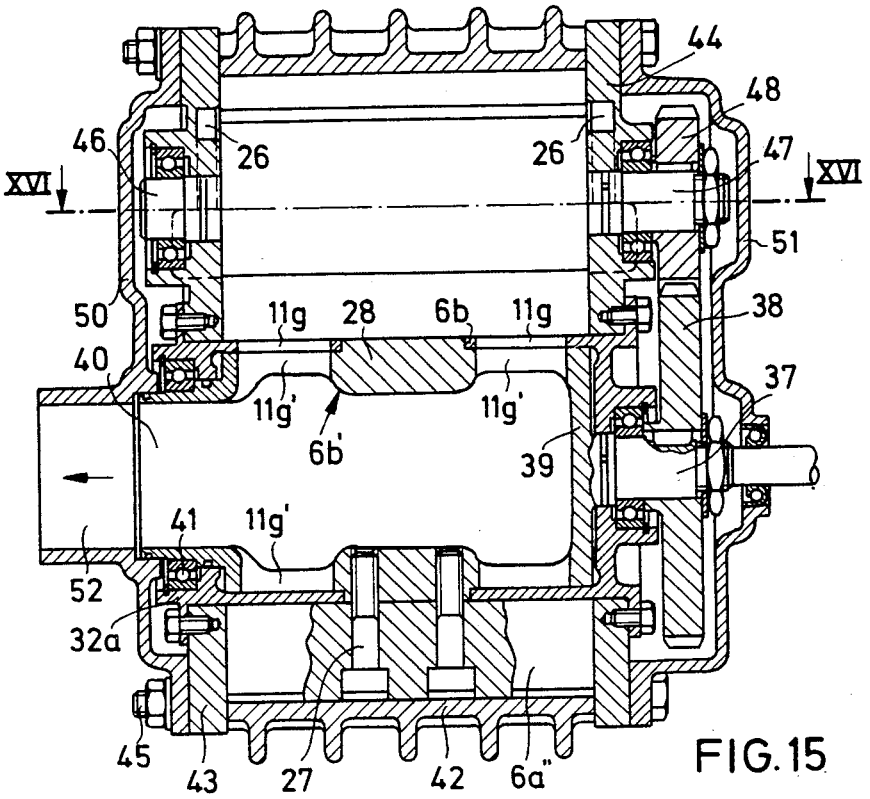
FIG. 15 is an axial or longitudinal cross-sectional view through the axles of the two drivers and one piston by means of a structural embodiment of a rotary piston machine, e.g., corresponding to FIG. 13.

FIG. 7 shows a rotary piston rotor and the sealing rotor 4*a* at the beginning of the stroke as the piston 6*a*″ passes through the meshing space of the shutoff rotor 4*a*, which is bordered by the meshing lines 14*a* and 14*b*. Lines 14*a* and 14*b* define in phantom lines the path traversed by the meshing piston element and define path portions where contact between the meshing rotating elements are interrupted because of the recess in the closure rotor 4*a*. *A comparison of the rotating positions of FIGS. 7 and 8 shows that the peripheral surface 9b* of the shutoff rotor 4*a* moves in a direction toward the surface 10*a* (FIG. 8) of the piston 6*a*″ and the cylindrical peripheral surface 10*b* of a cylindrical counter element 6*a*. In order to prevent a squeezing or compression of the gas in the space 15*b* between the surfaces moving toward each other, in the direction in which the space 15*b* becomes increasingly smaller in the counter rotor 6*a*, an open 11*c* is provided communicating with an opening 11*c*′ provided in the hollow shaft 6*a*′. After the relative direction of movement between the surfaces has been reversed, i.e., they move away from each other, the gas can then flow off in the direction of the hollow shaft, as shown in FIG. 15 depicting a compressor embodiment. The openings 11*c*, 11*c*′ positioned in the direction of the motion of the surface 9*b* correspond in the FIG. 7 embodiment to a recess 11, 11′ of the embodiment of the FIGS. 5 and 6, and the flow off channel 12*c* in the hollow shaft illustrated in FIG. 7 to the side opening 12 in the side housing wall 2 of FIGS. 5, 6.

Figure 11:
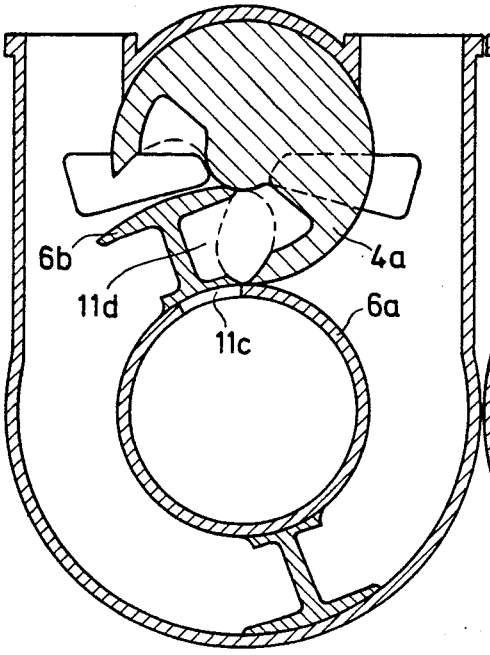
FIGS. 11 and 12 are additional machine embodiments illustrated in section of a rotary piston machine with piston rotors of a different design.

The embodiment of FIG. 11 shows that the opening 11*c* in the nonmoving counter element 6*a* can be combined with a recess 11*d* of the piston 6*b* in order to reduce even further losses due to compressed flows.

Figure 12:
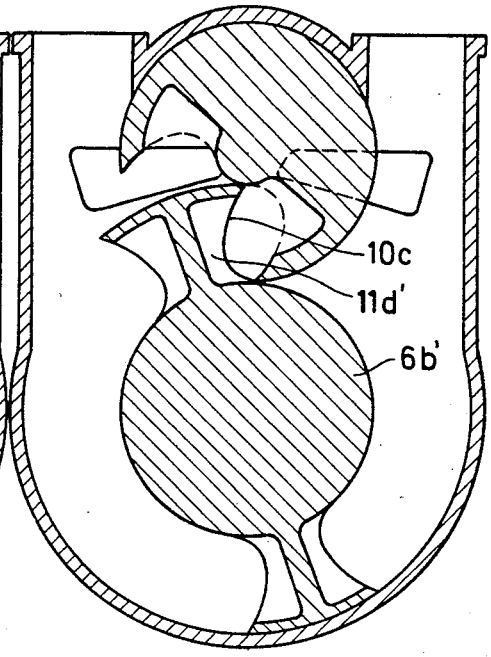

In the embodiment of FIG. 12, instead of the presence of openings 11*c*, 11*c*′ of the embodiment of FIGS. 7 and 8, only one recess 11*d*′ is provided which prevents a compression or squeezing of the flow in the space 15*b* (FIGS. 7, 8). This embodiment is simpler; however, in order to avoid losses due to compressed flows, it does include a corresponding detrimental space. The line 10*c* indicates the limiting of side surfaces of the piston of the piston rotor 6*b*′.

Figure 9:
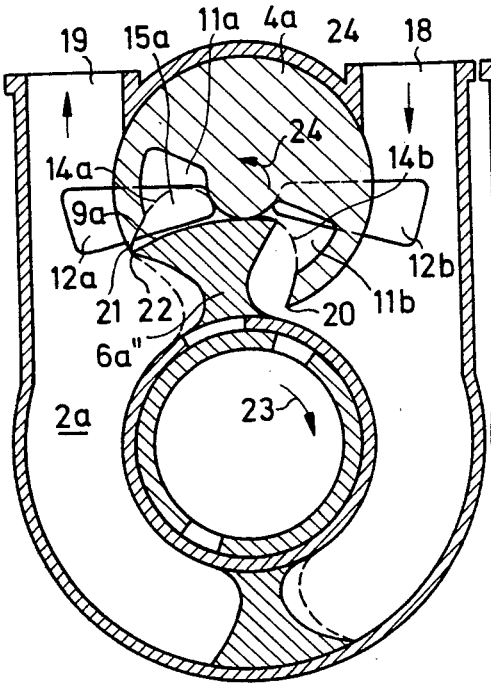

FIG. 9 shows the rotary piston machine of FIGS. 7 and 8 in another position of rotation as the piston 6*a*″ passes through the meshing space 15*a* of the sealing rotor 4*a*, in which a considerably compressed flow could also be present in the absence of recess 11*a*, extending beyond the meshing line 14*a* in accordance with this invention. This recess 11*a* is placed adjacent to the meshing edge 21 of the sealing rotor 4*a* and its distance from this meshing edge should be made as small as possible keeping in mind the mechanical stresses. The meshing edge 22 of the piston 6*a*″ at the end of its peripheral surface 9*a* moves because of the rotation of the rotor in the direction of the arrows 23, 24 along the meshing line 14*a* bordering the meshing space 15*a*. Here, as contact is made in the two axial directions of the machine, the recess 11*a* is connected to a slot-shaped opening 12*a* in the housing side wall 2*a*, which makes possible a flowing off into the flow off channel 19. This flow off to the side can be arranged as shown in the drawing in FIG. 16.

It should be understood that, as used herein, the term "meshing line" means the locus of points taken relative to the sealing rotor which the piston follows as it moves through the sealing rotor recess.

When rotated again from the position shown in FIG. 9, the peripheral surface 9*a* of the piston moves away from the meshing line 14*b* illustrated in phantom line or meshing surface and, at the same time, in order to prevent the development of low pressure, a recess 11*b* is provided in the sealing rotor 4*a*, which can have exactly the same shape as the previously mentioned recess 11*a* with a symmetrically inverse arrangement. This recess 11*b* is disposed adjacent to the meshing edge 20. The recess 11*b* is also connected in an axial direction with an opening 12*b* which leads to the inlet channel 18.

From the drawing in FIG. 9 it can be seen that the recess 11*b* in combination with the connecting opening 12*b* to the inlet channel 18 also makes possible in an advantageous way the start up of the machine from the position shown, i.e., without any help in starting up, by means of the gas pressure which acts in the recess 11*b* on the sealing rotor and thus torque is produced. The two drivers are connected together in the driving mode as by gears as can be seen in the embodiment shown in FIG. 15.

Figure 10:
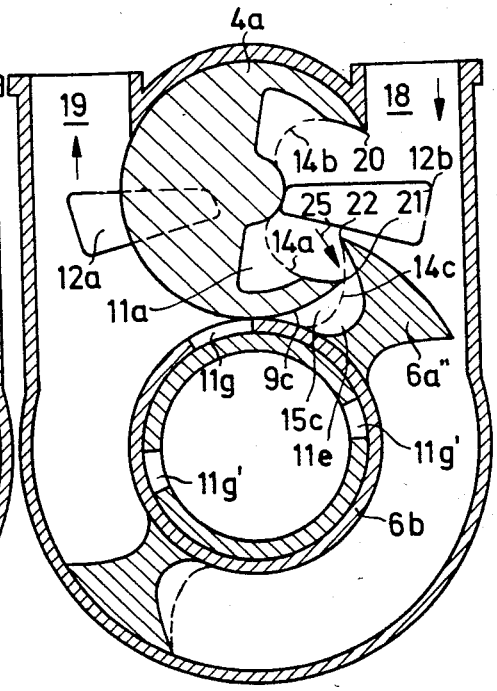

FIG. 10 shows an additional expedient for avoiding a reverse compressed flow or suction flow when the surface 9*c* of the sealing rotor 4*a* moves away from the meshing line 14*c* of the piston 6*a*″. A recess 11*e* has also been provided for this which makes possible an after flow of gas into the space 15*c* in the direction of the arrow 25.

Figure 13:
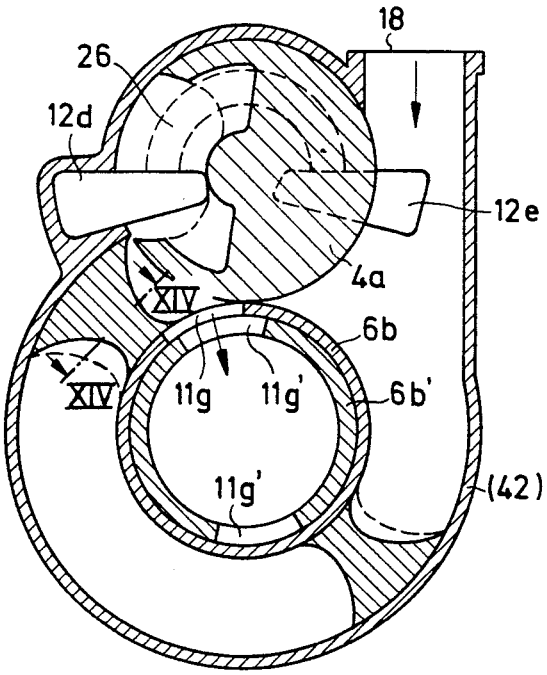
FIG. 13 is a sectional view of a rotary piston machine in which the main flow is conducted through the hollow shaft of the piston drive.
Figure 14:
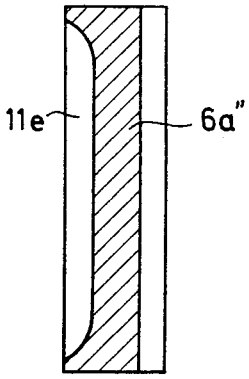
FIG. 14 is a sectional view taken along line XIV—XIV of FIG. 13 through a rotary piston.

FIG. 13 shows an embodiment of a rotary piston machine in which the main stream of the machine passes through the hollow shaft 6*b*′ of the piston rotor. It is understood that this machine, just like the previously described rotary piston machines, can be driven by the pressure of an inflowing medium or can displace or compress a medium by mechanically activating the rotors. Moreover, it is also possible to reverse the direction of the flow. The openings 11*g*, 11*g*′ in the nonmoving ring element 6*b* and the hollow shaft 6*b*′ correspond to the openings 11*c*, 11*c*′ of the embodiment illustrated in FIGS. 7 and 8; however, they are constructed to be in the peripheral direction. Furthermore, this machine is different because of the absence of a channel 19 (FIG. 7) placed opposite the inflowing channel 18 and the presence of a ring channel 26 (FIG. 15) indicated in FIG. 13 by broken lines, which connects the side openings 12*d*, 12*e* to each other.

The two openings 11*g* and 11*g*′ are covered only when the piston rotor is in a certain angle of rotation so that together they form a controlled valve. The deflection of the stream of gas which is produced in this way has the advantage of the piston rotor not having to move constantly against the full counter pressure when this machine is used as a compressor.

A rotary piston compressor, in which the stream of gas is conducted through the hollow shaft and is deflected by relative twisting between one nonmoving and one rotating ring element, is well-known. Its development can be traced back to an unpublished German (Patent) Application No. 503 579 of the applicant dated Aug. 2, 1940. A sample embodiment was published, for example, in "THE OIL ENGINE" of March 1955, page 418. In this well-known machine, both rotors are designed as piston rotors with a hollow shaft, and the two hollow shafts rotating toward each other between the high and low pressure sides in order to make a seal, have a difference between the outer and inner diameter equal to the radial height of the pistons, so that it is possible to provide recesses similar to tooth gaps for the stroke or passage of the piston in the wall of each hollow shaft. In order to make it possible to control the exchange of gas in these machines, both hollow shafts must have smooth cylindrical surfaces on the inside for the control of modulating capsules that are placed inside and surrounded by the hollow shaft. Consequently, such a machine has very massive hollow shafts interrupted in the peripheral direction by the aforementioned recesses. Such shafts have gravitation or inertia forces that permit only very low speeds. Only at low attainable speeds may such machine accommodate acceptable dimensions, as, for example, when used to charge an internal compression engine. Furthermore, in this well-known rotary piston compressor of the prior art, sizeable compressed flows as well as detrimental spaces occur in the meshing area between the two rotors.

Figure 17:
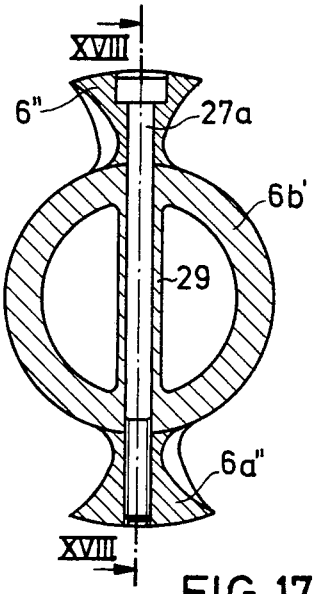
FIG. 17 is a radial sectional view taken through a further embodiment of a piston driver, e.g., for a machine corresponding to FIG. 15 with a center hub.
Figure 18:
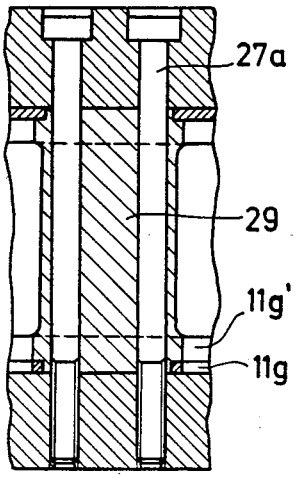
FIG. 18 is a partial axial sectional view taken along line XVIII—XVIII of FIG. 17.
Figure 19:
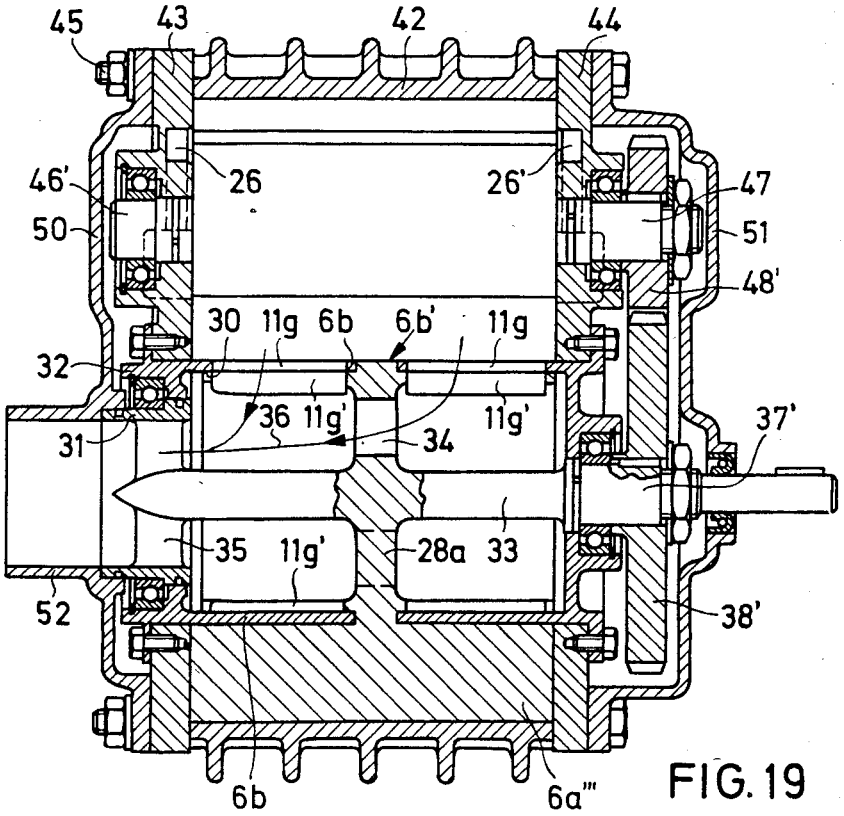
FIG. 19 is an axial sectional view corresponding to FIG. 15 with a further embodiment and a piston rotor.

In contrast to this well-known rotary piston compressor, in the embodiment of the aforementioned FIG. 13 as well as those of FIG. 20*a–e* and 22*a–e*, there is only one piston rotor present, while the other rotor only rotates as a shut-off or sealing rotor without stress due to torques. Because it rotates, moreover, at a higher speed than the piston rotor at the ratio of 2:1 in the sample embodiments shown, which corresponds to the ratio between the number of pistons on the piston rotor and the number of gaps on the sealing rotor, the result is a considerably smaller sized structure with the same volume of flow as well as smaller detrimental spaces, as will be explained in greater detail below. The placement of the nonmoving ring element on the periphery of the hollow shaft of the piston driver as shown in the drawings of FIGS. 7 to 13 and 15 to 19, also has the advantage that the detrimental space present due to the opening 11*g* is especially small, because this nonmoving ring element 6*b* can be constructed with especially thin walls, since it is not exposed to any significant mechanical stresses. FIGS. 15 and 19 show how it is structurally possible to have a nonmoving ring element 6*b* placed around the hollow shaft.

The most important step to take so that the aforementioned arrangement of the nonmoving ring element 6*b* can be realized, consists in attaching or fastening the pistons on a center hub part of the hollow shaft and omitting the otherwise customary front cover disks of the piston driver so that the nonmoving ring element 6*b* can make contact or engage in the space between the rotating piston 6*a*" and the hollow shaft 6*b*' in two parts from two axial sides, as is shown in the axial sectional drawing of FIG. 15.

In FIG. 15, in order to simplify the drawing, the sealing rotor 4*a* was not shown. The rotating pistons 6*a*", of which, for example in FIG. 13, two placed diametrically opposite each other are provided, are each fastened by two screws 27 to the hub part 28 of the hollow shaft 6*b*' of the rotating piston rotor. As the sectional drawings of FIGS. 17, 18 show, the screws 27 can also be designed as long screws 27*a* extending diagonally to the other piston 6*a*". In this case, the hollow shaft 6*b*' has a diametral transverse strip 29 through which the screws 27*a* are extended. Fastening by means of screws 27, 27*a* makes possible high centrifugal stresses on the pistons, even though they are only fastened in their middle area, i.e., in the area of the shaft hub 28. Moreover, the use of screws results in advantages as regards the simpler manufacture of piston rotors as well as the replacement of pistons after wear.

FIG. 19 shows an embodiment of a rotating piston machine which is designed similar to those in FIG. 15, with a significant difference, however, in that the piston 6*a*"' is formed in one piece with a relatively narrow hub 28*a* of the hollow shaft 6*b*'. The shaft 6*b*' has an outer capsule element 30, which extends away from the periphery of the hub part 28*a* on both sides in an axial direction, as well as a neck part 31 at the outlet end of the hollow shaft 6*b*' for support, opposed to a nonmoving housing part 32. The hub 28*a* as well as the neck part 31 are supported by the center shaft 33 of the hollow shaft 6*b*', and openings 34 in the hub part 28*a* as well as connecting strips 35 between the center shaft 33 and the neck part 31 allow the axial flow in the hollow shaft in the direction of the arrows 36.

It is understood that the hollow shaft 6*b*' corresponding to the sample embodiment of FIG. 15 must be of a more massive construction for reasons of strength since its hub part 28 is shaped like a ring, i.e., has no supporting disk as in the sample embodiment in FIG. 19. For connection with a shaft journal 37, which is used as a bearing as well as an attaching device for a gear 38, in contrast to the embodiment in FIG. 19, the hollow shaft 6*b*' is provided with a bottom part 39 (FIG. 5). The shaft neck 40 at the outlet end of the hollow shaft 6*b*' is supported by means of a bearing 41 on the nonmoving housing part 32*a*, which extends into the ring element 6*b* just as in the embodiment in FIG. 19.

Figure 16:
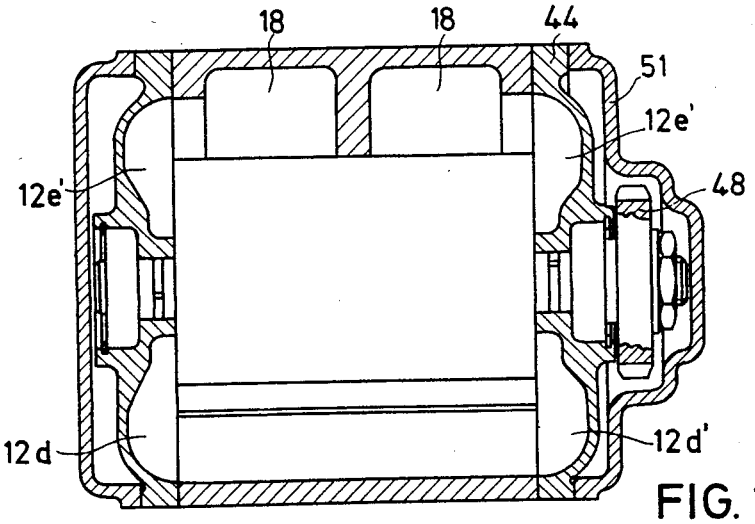
FIG. 16 is a sectional view taken along line XVI—XVI of FIG. 15 through the blocking drive with adjacent housing.

The remaining design of the machine housing, the bearing of the shutoff driver and of the drive connection is identical in the two embodiments of FIGS. 15 and 19. A peripheral part 42 of the housing which surrounds the two drivers, is clamped between two housing side walls 43, 44 by means of an extended screw 45. The side walls 43, 44 are used for the lateral sealing of the rotors as well as for supporting the shaft journals 37, 37' (31, 40) of the piston rotor as well as the shaft journals 46, 47 of the sealing rotor. Furthermore, they accommodate the ring channel 26 (FIG. 13), which connects the slot openings 12*d* and 12*e* to each other. Since the piston rotor has two pistons placed diametrically opposite each other, while the sealing rotor has only one receiving opening for the passage or stroke of the piston, because of the contact or meshing of the gears 38, 48 of the two drivers or rotors, the transmission ratio is 1:2, i.e., the sealing rotor must rotate twice as fast as the piston rotor. The bearings on the two sides of the rotors as well as the drive connection by means of the gears 38, 48 are enclosed on the outside by housing plates 50, 51, which enclosed on the outside by housing plates 50, 51, which are clamped together with the housing side walls by means of the housing screws 45. One of the housing plates 50 supports the inlet (outlet) connecting piece 52, while the incoming (outgoing) flow occurs tangential to the machine by way of the channels 18 (FIGS. 13, 16).

FIGS. 20*a*–20*e* and 22*a*–22*e* show two embodiments of a rotary piston machine, suitable as a charger for an internal combustion engine, for example, in which the main flow also is conducted through the hollow shaft of one of the rotors, which is constructed as a piston rotor, while the other driver only rotates along with it as the sealing rotor. In contrast to the sample embodiment in FIG. 13, the nonmoving control capsule 6*d* or also the one that has adjustable angles for purposes of control is placed inside the hollow shaft 6*d*' of the piston rotor as is known from the earlier mention of the compressor with two piston rotors and from the article in the magazine "THE OIL ENGINE" (March 1955, page 418). Rotary piston machines with two rivers, of which only one is a piston rotor while the other is a sealing rotor, and in which the flow is through the hollow shaft of the piston rotor, are known and embodied in steam engines in U.S. Pat. No. 516,385 and embodied in combustion engines in U.S. Pat. No. 3,923,014. The speed ratio of the rotors in these machines is 1:1, however, and the sealing rotor causes the machine to be relatively large in its dimensions. The recess in the sealing rotor is exactly the shape here that is necessary because of the movement of the piston as a generator. Thus, the compresed flows to be avoided according to this invention also occur in these machines. The design of such a machine as a charger, for example, with a hollow shaft considerably larger in its diameter, with a diameter that is approximately equal to the diameter of the sealing rotor, would lead to a design which is shown, for example, in the drawing in FIG. 21. Comparing such a machine with the sample embodiments of this invention, e.g., corresponding to FIGS. 13, 20 *a–e* and 22 *a–c*, clearly shows the advantages of these embodiments of the invention. In FIG. 20*a* and FIG. 21 the piston rotor is shown each time in a position of rotation in which the rear edge 55, 55' is opposite the flow opening 11*h* in the hollow shaft 6*d*' of the sealing edge 56, 56' of the control or modulating capsule 6*d*, and in the case of a charger the expulsion is completed through the opening 11*h*'.

In a machine corresponding to the drawing in FIG. 21, this flow opening 11*h*' in the control capsule must be sealed by the hollow shaft in a considerably earlier position of the piston 58' in the rotating direction, since when it rotates further in the direction of the arrow 59, the seal at the position 60' will be lifted and the detrimental space 62 will be reached, which is formed by areas under the low pressure between the front surface of the piston and the recess of the sealing rotor 4*b'* in connection with the suction end 61 of the machine. The space 62 of a machine corresponding to the embodiment of FIG. 20, which is comparable to this very large detrimental space 62', is many times smaller. Moreover, this space 62 opens when the rotor rotates further into the hollow space of the sealing rotor 4*b*, which is composed of the recess 15*e* bordered by the meshing line 14*e* and the alternate space 11*k* extending beyond the meshing line. The resulting intermediate pressure tension release into this space 15*e*, 11*k* is produced because the edge 64 moves more quickly in the direction of the meshing line 14*h* "generated" by it than the edge 65 of the opening 11*h* in the hollow shaft from the position shown in FIG. 20*a* moves away from the sealing peripheral surface 9*h* of the sealing rotor, which is due to the faster rotating speed of the sealing rotor in comparison with the piston rotor.

An open surface 66 undercutting the piston 58 makes possible this intermediate pressure tension release after the edge 64 of the sealing rotor has moved to the open surface 66. Corresponding to the size ratio between the space 62 and the hollow space 15*e*, 11*k* of the sealing rotor the detrimental gas volume enclosed in this space 62 is released, since this intermediate pressure tension release thus occurs inside the machine, it is not connected with any significant generation of noise. The slight low pressure that has been produced in the hollow space 11*e*, 11*k* of the sealing rotor by this intermediate pressure tension is released backwards into the pressure space 67 of the machine after the rear edge 68 of the piston 58 has left the edge 69 of the housing, as is the cae when it moves from the position in FIG. 20*b* into the position of FIG. 20*c*. The loss in efficiency due to a detrimental volume is thus reduced to an inconsequential amount by two measures, i.e., by the fact that the detrimental space 62 is made smaller and the detrimental gas volume under the pressure reduced by the intermediate pressure tension release reaches the suction end 61 of the machine.

This intermediate pressure tension release into the hollow space of the sealing rotor enlarged by the alternate space 11*k* has the additional advantage that in any case, compressed flows that are still present occur when the peripheral surface 70 of the piston 58 moves, for example, toward the sealing inner surface 71 of the sealing rotor at a correspondingly reduced pressure of the gas or air. As is shown in the embodiment of FIG. 22*a* described below, this surface 71 of the sealing rotor can also be avoided, however.

The additional embodiment shown in FIG. 22 can be manufactured more economically since the edge 64', 64'' of the sealing rotor 4*k*, 4*k'* does not have to move in contact with a side surface of the piston 58'. In this example also, because of the higher rotating speed of the sealing rotor a stroke or passage of the piston through a small detrimental space results in less loss and compressed flows are avoided to a great extent.

In FIG. 22*a* an embodiment of the sealing driver is shown in which the rotor also has an alternate space 11*m* in order to avoid compressed flows and for an intermediate pressure tension release. An extensive avoidance of compressed flows and an intermediate pressure tension release is also achieved, however, with the embodiment of FIGS. 22*b*–22*e*, since the piston 58' and recess 70 are of such a shape and dimension that the surfaces of the piston do not come into contact with the border surface of the recess 70, as is shown by the various rotating positions in FIGS. 22*b*–*e*. The piston 58' thus passes untouched through the recess 70 of the sealing rotor 4*k'*. *The drawing of the shutoff driver of FIGS. 22b–e,* in particular, is only schematic and it is understood that hollow spaces are provided in the sealing rotor that prevent imbalances or out-of-balances during rotor rotation. These hollow spaces are advantageously connected to the recess 70. The shutoff rotor can also have numerous hollow spaces 11*m* arranged consecutively in the axial direction as shown in the drawing in FIG. 22*a* and it can have disks with full profiles between these hollow spaces as shown in the drawings in FIGS. 22*a*–*e*.

A comparison of the shape of the pistons of the piston rotors of the embodiments as shown in FIGS. 20 and 22 with those of the embodiments described earlier, for example, in FIG. 13, shows that the pistons as shown in FIGS. 20 and 22 are considerably narrower in the peripheral direction or toward the rear. This makes it possible for the contact surface in the sealing rotor for the pistons to be constructed considerably smaller in the peripheral direction, smaller even than shown in FIGS. 20*a* to 20*e*.

The axial or longitudinal cross-sectional views of FIGS. 23 and 24 of a rotary piston machine corresponding to the embodiments of FIGS. 20 and 22 show the substantial structural simplification resulting from the arrangement of the control or modulating capsule 6*d* compared to the embodiments shown in FIGS. 15 and 19. The modulating capsule 6*d* is supported opposite the hollow shaft 6*d'* by a bearing 72, so that it can rotate and so that it is possible to influence the control times or the performance of the machine. The shafts 74, 75 of the sealing rotor and of the piston rotor respectively are placed over two gears 76, 77 in a drive connection. Since the sealing rotor is not exposed to any significant torques, as an advantage, a very slight stress is produced on this drive connection 76, 77. The design of the machine housing is comparable to the sample embodiments of FIGS. 15 and 19.

The embodiment of FIG. 24 is different from the embodiment in FIG. 23 in that the piston 58 makes contact between the side view sealing wall 79, 80 of the sealing rotor 41. This sectional drawing also shows in the contact position between the piston rotor and the sealing rotor, a radial alternate space 81 present between the radial outer surface 82 of the piston 58 and the boundary surface 83 of the recess of the sealing rotor 41. The partially visible hollow space 84 of the sealing rotor is also used for compensating imbalances or out-of-balances. The sealing rotor is supported by means of the shaft journal 74 and the axle journal 85.

The preceding description has demonstrated how the general principles and benefits of this invention explained at the beginning with respect to FIGS. 3 and 4 can lead to various structural improvements in a rotary piston machine. The illustrative embodiments show that by means of appropriate shapes and dimensions in the area of the mutual contact between the two rotors, generally adequate flow profiles can be achieved, i.e., the squeezing or compression of the displaced or displacing medium can be prevented. When combined, these improvements lead to a machine with surprisingly slight losses of flow so that it can also be used in speed ranges in which until now only turbo machines seemed suitable.

The performance and efficiency of the machine of this invention depends only to an insignificant extent on the speed of its rotors. Furthermore, the avoidance of compressed flows in the manner described also leads to the avoidance of interruptions or dead centers so that the machine powered by a stream of gas does not require any help in starting up. Finally, with the avoidance of compressed flows it was also shown how a detrimental space can be substantially reduced in size.

As the foregoing description has suggested a number of modifications of the embodiments of this invention illustrated in the drawing, this invention is to be limited only by the scope of the appended claims.

What is claimed is:

1. A rotary piston engine comprising:

a piston rotor including piston means forming at least one piston member on said piston rotor;

a sealing rotor shaped to define primary recess means forming at least one primary recess through which said piston means pass during relative rotation between said sealing rotor and said piston rotor;

said sealing rotor and said piston rotor being mounted for intermeshing relative rotation therebetween about parallel rotative axes;

a meshing line defined as a locus of points taken relative to said sealing rotor which said piston means follows during movement thereof through said primary recess means;

housing means defining a fluid flow-path for a flowable medium enveloping said rotors;

said sealing rotor having a cylindrical outer surface interrupted by said primary recess means, said primary recess means being defined with terminal edges contiguous with said cylindrical outer surface and extending as uninterrupted straight lines parallel with each other along said cylindrical outer surface; and secondary recess means forming at least one secondary recess directly contiguous with said primary recess means along said meshing line so as to extend said primary recess means beyond said meshing line to avoid losses due to compressed flows by compression of fluid within said primary recess means by the relative movement between surfaces of said piston means and said sealing rotor, said secondary recess means commencing from a point spaced from said terminal edges of said primary recess means and being located radially inwardly relative to said cylindrical outer surface.

2. In a rotary piston engine comprising a piston rotor and a sealing rotor which rotate about axes of rotation disposed in fixed relation; said piston rotor including a piston mounted on a rotatable shaft; said sealing rotor having a primary recess for passage therethrough of said piston; said sealing rotor and said piston rotor generating a meshing line which constitutes the locus of points which the piston follows relative to the sealing rotor as said piston moves through said primary recess; a common housing having an inlet for a flowable medium enveloping said rotors; said piston rotor shaft being hollow and having a first radially-extending passageway for a flowable medium; a control sleeve for controlling the passage of a flowable medium through said hollow shaft, which sleeve surrounds said hollow shaft; said rotor being rotatable relative to said sleeve; said sleeve having a second radially extending passageway; said radially extending passageways being intermittently superposed in the course of rotation of said piston rotor; the improvement comprising a secondary recess connected with said primary recess which extends beyond the meshing line in at least the approximate direction of motion of the rotor surfaces generating said meshing line, and which secondary recess is adjacent and contiguous with said primary recess; wherein a leading surface of said piston in the direction of rotation has an undercut surface, and said sealing rotor has a sealing contact edge which engages said undercut surface; said control sleeve maintaining the radially extending passageway of said hollow piston rotor shaft open until said contact edge disengages from the piston; the inner end limit of the undercut surface terminating at the edge of the radially extending passageway in the hollow shaft for said piston.

3. The rotary piston engine of claim 2 in which said piston rotor comprises two pistons mounted on said hollow shaft, and said hollow shaft has two radially extending passageways; said sealing rotor having at least one recess for passage of the pistons of said piston rotor; said control sleeve being stationary and encircling said piston rotor; one of said passageways of said hollow shaft and said sleeve passageway being in superposed relation during passage of each piston through the primary recess of said sealing rotor.

4. The rotary piston engine of claim 2 in which said piston rotor comprises at least two pistons, and the speed of rotation of the sealing rotor is greater than that of the piston rotor by a ratio of 2:1.

5. The rotary piston engine of claim 2 in which the trailing edge of the piston as determined by the direction of piston rotor rotation, is disposed in advance of a plane extending through the axis of said rotor and the junction of the trailing surface of the piston with the outer surface of said hollow shaft.

6. The rotary piston engine of claim 2 in which said hollow shaft has a hub, and at least one rotating piston is fastened to the periphery of the hollow shaft by screws secured in the shaft by screws secured in the shaft hub.

7. The rotary piston engine of claim 2 in which said piston rotor comprises two rotating pistons placed diametrically opposite each other and connected by at least one screw extending through the hollow shaft.

8. The rotary piston engine of claim 2 in which said sealing rotor has a primary recess with an inner circular surface portion disposed therein, and said piston has cylindrical peripheral surface portions which roll within the primary recess of said sealing rotor about said inner circular cylindrical surface disposed in said recess; a secondary recess being disposed within said sealing rotor on each side of said circular surface for providing a low pressure compensation space during normal engine operation.

* * * * *